US011047023B2

(12) United States Patent
Shutoh et al.

(10) Patent No.: US 11,047,023 B2
(45) **Date of Patent: *Jun. 29, 2021**

(54) CU-NI-SI BASED COPPER ALLOY SHEET MATERIAL AND PRODUCTION METHOD

(71) Applicant: DOWA METALTECH CO., LTD., Tokyo (JP)

(72) Inventors: Toshiya Shutoh, Tokyo (JP); Hisashi Suda, Tokyo (JP); Fumiaki Sasaki, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 362 days.

This patent is subject to a terminal disclaimer.

(21) Appl. No.: 16/087,829

(22) PCT Filed: Oct. 14, 2016

(86) PCT No.: PCT/JP2016/080542

§ 371 (c)(1),
(2) Date: Sep. 24, 2018

(87) PCT Pub. No.: WO2017/168803

PCT Pub. Date: Oct. 5, 2017

(65) Prior Publication Data

US 2019/0106769 A1 Apr. 11, 2019

(30) Foreign Application Priority Data

Mar. 31, 2016 (JP) ..... JP2016-072218
Aug. 30, 2016 (JP) ..... JP2016-167515

(51) Int. Cl.

| | |
|---|---|
| ***C22C 9/06*** | (2006.01) |
| ***C22F 1/08*** | (2006.01) |
| ***C22C 9/10*** | (2006.01) |
| ***B21B 3/00*** | (2006.01) |
| *B21D 1/10* | (2006.01) |

(52) U.S. Cl.
CPC ..... *C22C 9/06* (2013.01); *C22C 9/10* (2013.01); *C22F 1/08* (2013.01); *B21B 2003/005* (2013.01); *B21D 1/10* (2013.01); *C22C 2200/00* (2013.01); *C22C 2202/00* (2013.01)

(58) Field of Classification Search
CPC ..... C22C 9/06; C22C 9/10; C22C 2200/00; C22C 2202/00; C22F 1/08; B21B 2003/005; B21D 1/10
See application file for complete search history.

(56) References Cited

U.S. PATENT DOCUMENTS

| | | | | |
|---|---|---|---|---|
| 5,846,346 | A * | 12/1998 | Lee | H01B 1/026 148/433 |
| 2012/0148439 | A1* | 6/2012 | Shishido | C22C 1/02 420/473 |
| 2020/0140982 | A1* | 5/2020 | Hyodo | C22C 9/00 |

FOREIGN PATENT DOCUMENTS

| | | |
|---|---|---|
| CN | 104726744 | 6/2015 |
| JP | 06-041660 | 2/1994 |
| JP | 2010-007174 | 1/2010 |
| JP | 2011-038126 | 2/2011 |
| JP | 2011-162848 | 8/2011 |
| JP | 2012-126930 | 7/2012 |
| JP | 2012-126934 | 7/2012 |
| JP | 2012-177153 | 9/2012 |
| JP | 2012-211355 | 11/2012 |

OTHER PUBLICATIONS

Kotaro Izawa et al., "Influence of Co . . . a Cu—Ni—Co—Si Alloy", Copper and Copper Alloy, vol. 52, No. 1, Aug. 1, 2013, pp. 131-135.

* cited by examiner

*Primary Examiner* — John A Hevey
(74) *Attorney, Agent, or Firm* — Clark & Brody LP

(57) ABSTRACT

A copper alloy sheet material that is excellent in surface smoothness of an etched surface has a composition containing, (mass %), from 1.0 to 4.5% of Ni, from 0.1 to 1.2% of Si, from 0 to 0.3% of Mg, from 0 to 0.2% of Cr, from 0 to 2.0% of Co, from 0 to 0.1% of P, from 0 to 0.05% of B, from 0 to 0.2% of Mn, from 0 to 0.5% of Sn, from 0 to 0.5% of Ti, from 0 to 0.2% of Zr, from 0 to 0.2% of Al, from 0 to 0.3% of Fe, from 0 to 1.0% of Zn, the balance Cu and unavoidable impurities. A number density of coarse secondary phase particles has a major diameter of 1.0 μm or more of $4.0\times10^3$ per square millimeter or less. KAM value measured with a step size of 0.5 μm is more than 3.00.

6 Claims, No Drawings

CU-NI-SI BASED COPPER ALLOY SHEET MATERIAL AND PRODUCTION METHOD

TECHNICAL FIELD

The present invention relates to a high strength Cu—Ni—Si based copper alloy sheet material that is suitable as a material for a lead frame having high-precision pins with a narrow width formed by photoetching, and a production method thereof. The "Cu—Ni—Si based copper alloy" referred in the description herein encompasses a Cu—Ni—Si based copper alloy of a type that has Co added thereto.

BACKGROUND ART

The production of a high-precision lead frame requires precision etching in a 10 μm order. For forming a pin having good linearity by the precision etching, the material is demanded to have an etched surface having surface unevenness as less as possible (i.e., having good surface smoothness). Furthermore, for decreasing the size and the thickness of the semiconductor package, the pin of the lead frame is demanded to have a narrower width. For achieving the pin having a narrower width, it is important to increase the strength of the material for the lead frame. Moreover, for producing a lead frame having high dimensional accuracy, it is advantageous that the shape of the sheet material as the material therefor is extremely flat in the stage before working.

As the material for the lead frame, a metal material that is excellent in characteristic balance between the strength and the electrical conductivity is selected. Examples of the metal material include a Cu—Ni—Si based copper alloy (i.e., a so-called Corson alloy) and a copper alloy of the same type that has Co added thereto. These alloy systems can be controlled to have a high strength with a 0.2% offset yield strength of 800 MPa or more while retaining a relatively high electrical conductivity (e.g., from 35 to 60% IACS). PTLs 1 to 7 describe various techniques relating to the improvement of the strength and the bend formability of the high strength Cu—Ni—Si based copper alloy.

According to the techniques of these literatures, an improvement effect can be found for the strength, the electrical conductivity, and the bend formability. However, for producing the aforementioned high-precision lead frame with high dimensional accuracy, no satisfactory result cannot be obtained for the surface smoothness of the etched surface. Furthermore, there is a room of improvement in the shape of the sheet material as the material therefor.

CITATION LIST

Patent Literatures

PTL 1: JP-A-2012-126934
PTL 2: JP-A-2012-211355
PTL 3: JP-A-2010-7174
PTL 4: JP-A-2011-38126
PTL 5: JP-A-2011-162848
PTL 6: JP-A-2012-126930
PTL 7: JP-A-2012-177153

SUMMARY OF INVENTION

Technical Problem

An object of the invention is to provide a Cu—Ni—Si based copper alloy sheet material that has a high strength and is excellent in surface smoothness of the etched surface. Another object thereof is to provide a sheet material that retains excellent flatness even in a cut sheet thereof.

Solution to Problem

According to the studies by the present inventors, the following matters have been found.

(a) For increasing the surface smoothness of the etched surface of the Cu—Ni—Si based copper alloy sheet material, it is significantly effective that a structure state having a large KAM value, which is obtained by EBSD (electron backscatter diffraction), is provided.

(b) For increasing the KAM value, it is significantly effective that an appropriate strain by cold rolling is applied between the solution treatment and the aging treatment, and in the final low temperature annealing, the temperature rising rate is controlled, so as not to become excessively large.

(c) For achieving a sheet material that is excellent in flatness even in a cut sheet thereof, it is significantly effective that (i) the work roll for the finish cold rolling performed after the aging treatment has a large diameter, and the single rolling reduction ratio in the final pass is restricted; (ii) in the shape correction with a tension leveler, the elongation rate is strictly controlled, so as to prevent excessive work from being applied; and (iii) the tension applied to the sheet in the final low temperature annealing is strictly controlled to a certain range, and simultaneously the maximum cooling rate is strictly controlled, so as to prevent the cooling rate from becoming excessively large.

The invention has been completed based on the knowledge.

The invention provides a copper alloy sheet material having: a composition containing, in terms of percentage by mass, from 1.0 to 4.5% of Ni, from 0.1 to 1.2% of Si, from 0 to 0.3% of Mg, from 0 to 0.2% of Cr, from 0 to 2.0% of Co, from 0 to 0.1% of P, from 0 to 0.05% of B, from 0 to 0.2% of Mn, from 0 to 0.5% of Sn, from 0 to 0.5% of Ti, from 0 to 0.2% of Zr, from 0 to 0.2% of Al, from 0 to 0.3% of Fe, from 0 to 1.0% of Zn, the balance of Cu, and unavoidable impurities; having a number density of coarse secondary phase particles having a major diameter of 1.0 μm or more of $4.0\times10^3$ per square millimeter or less, on an observation surface in parallel to a sheet surface (rolled surface); and having a KAM value measured with a step size of 0.5 μm of more than 3.00, within a crystal grain assuming that a boundary with a crystal orientation difference of 15° or more by EBSD (electron backscatter diffraction) is a crystal grain boundary.

Among the aforementioned alloy elements, Mg, Cr, Co, P, B, Mn, Sn, Ti, Zr, Al, Fe, and Zn are elements that may be arbitrarily added. The "secondary phase" is a compound phase that is present in the matrix (metal matrix). Examples thereof mainly include compound phases mainly containing $Ni_2Si$ or $(Ni,Co)_2Si$. The major diameter of a certain secondary phase particle is determined as the diameter of the minimum circle surrounding the particle on the observation image plane. The number density of coarse secondary phase particles can be obtained in the following manner.

Method for Obtaining Number Density of Coarse Secondary Phase Particles

The sheet surface (rolled surface) is electropolished to dissolve the Cu matrix only, so as to prepare an observation surface having secondary phase particles exposed thereon. The observation surface is observed with an SEM, and a value obtained by dividing the total number of the secondary phase particles having a major diameter of 1.0 μm or more observed on the SEM micrograph by the total observation area ($mm^2$) is designated as the number density of coarse secondary phase particles (per square millimeter). The total observation area herein is 0.01 $mm^2$ or more in total of plural observation view fields that are randomly selected and do not overlap each other. A secondary phase particle that partially protrudes from the observation view field is counted in the case where the major diameter of the part thereof appearing within the observation view field is 1.0 μm or more.

The KAM (kernel average misorientation) value can be obtained in the following manner.

Method for Obtaining KAM Value

An observation surface prepared by buffing and ion milling the sheet surface (rolled surface) is observed with an FE-SEM (field emission scanning electron microscope), and for a measurement field of 50 μm×50 μm, a KAM value within a crystal grain assuming that a boundary with an orientation difference of 15° or more is the crystal grain boundary is measured with a step size of 0.5 μm by EBSD (electron backscatter diffraction). The measurement is performed for measurement fields at five positions that are randomly selected and do not overlap each other, and an average value of the KAM values obtained in the measurement fields is used as the KAM value of the sheet material.

The KAM values of the measurement fields each correspond to a value obtained in such a manner that for electron beam irradiation spots disposed with a pitch of 0.5 μm, all the crystal orientation differences between the adjacent spots (which may be hereinafter referred to as "adjacent spots orientation differences") are measured, from which only measured values with an adjacent spots orientation difference of less than 15° are extracted, and an average value thereof is obtained. Accordingly, the KAM value is an index showing the amount of the lattice distortion within the crystal grain, and a larger value thereof can be evaluated as a material having larger crystal lattice distortion.

It is preferred that the copper alloy sheet material has an average crystal grain diameter in a sheet thickness direction defined by the following item (A) of 2.0 μm or less.

(A) Straight lines are randomly drawn in the sheet thickness direction on an SEM micrograph obtained by observing a cross sectional surface (C cross sectional surface) perpendicular to the rolling direction, and an average cut length of crystal grains cut by the straight lines is designated as the average crystal grain diameter in the sheet thickness direction. Plural straight lines are randomly set in such a manner that a total number of crystal grains cut by the straight lines is 100 or more, and the straight lines do not cut the same crystal grain within one or plural observation view fields.

It is preferred that the copper alloy sheet material has a maximum cross bow $q_{MAX}$ defined by the following item (B) of 100 μm or less with a sheet width $W_0$ (mm) in a direction perpendicular to a rolling direction.

(B) A rectangular cut sheet P having a length in the rolling direction of 50 mm and a length in the direction perpendicular to the rolling direction of a sheet width $W_0$ (mm) is collected from the copper alloy sheet material, and the cut sheet P is further cut with a pitch of 50 mm in the direction perpendicular to the rolling direction, at which when a small piece having a length in the direction perpendicular to the rolling direction of less than 50 mm is formed at an end part in the direction perpendicular to the rolling direction of the cut sheet P, the small piece is removed, so as to prepare n pieces of square specimens of 50 mm square (wherein n is an integer part of the sheet width $W_0/50$). The square specimens each are measured for a cross bow q when the specimen is placed on a horizontal plate in the direction perpendicular to the rolling direction for both surfaces thereof (sheet surfaces on both sides thereof), according to a measurement method with a three-dimensional measurement equipment defined in JCBA (Japan Copper and Brass Association) T320:2003 (wherein w=50 mm), and a maximum value of absolute values |q| of the values q of the both surfaces is designated as a cross bow $q_i$ (wherein i is from 1 to n) of the square specimen. A maximum value of the cross bows $q_1$ to $q_n$ of n pieces of the square specimens is designated as the maximum cross bow $q_{MAX}$.

It is preferred that the copper alloy sheet material has an I-unit defined by the following item (C) of 5.0 or less.

(C) A rectangular cut sheet Q having a length in a rolling direction of 400 mm and a length in a direction perpendicular to the rolling direction of a sheet width $W_0$ (mm) is collected from the copper alloy sheet material, and placed on a horizontal plate. In a projected surface of the cut plate Q viewed in a vertical direction (which is hereinafter referred simply to as a "projected surface"), a rectangular region X having a length in the rolling direction of 400 mm and a length in the direction perpendicular to the rolling direction $W_0$ is determined, and the rectangular region X is further cut into strip regions with a pitch of 10 mm in the direction perpendicular to the rolling direction, at which when a narrow strip region having a length in the direction perpendicular to the rolling direction of less than 10 mm is formed at an end part in the direction perpendicular to the rolling direction of the rectangular region X, the narrow strip region is removed, so as to determine n positions of strip regions (each having a length of 400 mm and a width of 10 mm) adjacent to each other (wherein n is an integer part of the sheet width $W_0/10$). The strip regions each are measured for a surface height at a center in width over the length of 400 mm in the rolling direction, a difference $h_{MAX}-h_{MIN}$ of a maximum height $h_{MAX}$ and a minimum height $h_{MIN}$ is designated as a wave height h, and a differential elongation rate e obtained by the following expression (1) is designated as a differential elongation rate $e_i$ (wherein i is from 1 to n) of the strip region. A maximum value of the differential elongation rates $e_1$ to $e_n$ of the n positions of the strip regions is designated as the 1-unit:

$$e=(\pi/2\times h/L)^2 \quad (1)$$

wherein L represents a standard length of 400 mm.

The sheet width $W_0$ is necessarily 50 mm or more. The copper alloy sheet material having a sheet width $W_0$ of 150 mm or more may be a preferred target. The copper alloy sheet material may have a sheet thickness, for example, of from 0.06 to 0.30 mm, and may be 0.08 mm or more and 0.20 mm or less.

As the characteristics of the copper alloy sheet material, the copper alloy sheet material having a 0.2% offset yield strength in a rolling direction of 800 MPa or more and an electrical conductivity of 35% IACS or more may be a preferred target.

The copper alloy sheet material may be produced by a production method containing in this order:

a step of subjecting an intermediate product sheet material having the aforementioned chemical composition to a heat treatment of retaining at from 850 to 950° C. for from 10 to 50 seconds (solution treatment step);

a step of subjecting to a cold rolling with a rolling reduction ratio of from 30 to 90% (intermediate cold rolling step);

a step of retaining at from 400 to 500° C. for from 7 to 15 hours, and then cooling to 300° C. at a maximum cooling rate of 50° C./h or less (aging treatment step);

a step of subjecting to cold rolling using a work roll having a diameter of 65 mm or more with a rolling reduction ratio of from 30 to 99% and a single rolling reduction ratio in a final pass of 10% or less (finish cold rolling step);

a step of subjecting to continuous repeated bending work with a threading condition that forms deformation with an elongation rate of from 0.10 to 1.50% with a tension leveler (shape correction step); and a step of subjecting to a heat treatment of raising the temperature to a maximum achieving temperature in a range of from 400 to 550° C. at a maximum temperature rising rate of 150° C./s or less, while applying a tension of from 40 to 70 N/mm$^2$ in a rolling direction of the sheet at least at the maximum achieving temperature, and then cooling to ordinary temperature at a maximum cooling rate of 100° C./s or less (low temperature annealing step).

Examples of the intermediate product sheet material subjected to the solution treatment include a sheet material after finishing hot rolling, and a sheet material that is obtained by further subjecting to cold rolling to reduce the sheet thickness.

The rolling reduction ratio from a certain sheet thickness $t_0$ (mm) to another sheet thickness $t_1$ (mm) can be obtained by the following expression (2).

$$\text{Rolling reduction ratio (\%)}=(t_0-t_1)/t_0\times 100 \quad (2)$$

In the description herein, a rolling reduction ratio in one pass in a certain rolling pass is particularly referred to as a "single rolling reduction ratio".

Advantageous Effects of Invention

According to the invention, a Cu—Ni—Si based copper alloy sheet material can be achieved that is excellent in surface smoothness of the etched surface and has a high strength and a good electrical conductivity. The sheet material is excellent in dimensional accuracy after processing into a precision component, and thus is significantly useful as a material of a component that is formed through fine etching, such as a lead frame having multiple pins for a QFN package.

DESCRIPTION OF EMBODIMENTS

Chemical Composition

The invention uses a Cu—Ni—Si based copper alloy. In the following description, the "percentage" for the alloy components means a "percentage by mass" unless otherwise indicated.

Ni forms a Ni—Si based precipitate. In the case where Co is contained as an additive element, Ni forms a Ni—Co—Si based precipitate. These precipitates enhance the strength and the electrical conductivity of the copper alloy sheet material. It is considered that the Ni—Si based precipitate is a compound mainly containing $Ni_2Si$, and the Ni—Co—Si based precipitate is a compound mainly containing $(Ni,Co)_2Si$. These compounds correspond to the "secondary phase" referred in the description herein. For sufficiently dispersing the fine precipitate particles effective for the improvement of the strength, the Ni content is necessarily 1.0% or more, and more preferably 1.5% or more. When Ni is excessive, a coarse precipitate tends to form, and the ingot tends to be cracked in hot rolling. The Ni content is restricted to 4.5% or less, and may be managed to less than 4.0%.

Si forms a Ni—Si based precipitate. In the case where Co is contained as an additive element, Si forms a Ni—Co—Si based precipitate. For sufficiently dispersing the fine precipitate particles effective for the improvement of the strength, the Si content is necessarily 0.1% or more, and more preferably 0.4% or more. When Si is excessive, on the other hand, a coarse precipitate tends to form, and the ingot tends to be cracked in hot rolling. The Si content is restricted to 1.2% or less, and may be managed to less than 1.0%.

Co forms a Ni—Co—Si based precipitate to enhance the strength and the electrical conductivity of the copper alloy sheet material, and thus may be added depending on necessity. For sufficiently dispersing the fine precipitates effective for the improvement of the strength, it is more effective that the Co content is 0.1% or more. However, when the Co content is increased, a coarse precipitate tends to form, and thus in the case where Co is added, the addition of Co is performed in a range of 2.0% or less. The Co content may be managed to less than 1.5%.

As additional elements, Mg, Cr, P, B, Mn, Sn, Ti, Zr, Al, Fe, Zn, and the like may be contained depending on necessity. The content ranges of these elements are preferably from 0 to 0.3% for Mg, from 0 to 0.2% for Cr, from 0 to 0.1% for P, from 0 to 0.05% for B, from 0 to 0.2% for Mn, from 0 to 0.5% for Sn, from 0 to 0.5% for Ti, from 0 to 0.2% for Zr, from 0 to 0.2% for Al, from 0 to 0.3% for Fe, and from 0 to 1.0% for Zn.

Cr, P, B, Mn, Ti, Zr, and Al have a function further increasing the strength of the alloy and decreasing the stress relaxation. Sn and Mg are effective for the improvement of the stress relaxation resistance. Zn improves the solderability and the castability of the copper alloy sheet material. Fe, Cr, Zr, Ti, and Mn readily form a high melting point compound with S, Pb, and the like existing as unavoidable impurities, and B, P, Zr, and Ti have a function of miniaturizing the cast structure, all of which can contribute to the improvement of the hot rolling property.

In the case where one kind or two or more kinds of Mg, Cr, P, B, Mn, Sn, Ti, Zr, Al, Fe, and Zn are contained, it is more effective that the total content thereof is 0.01% or more. However, when the elements are contained excessively, the elements adversely affect the hot or cold rolling property, and are disadvantageous in cost. The total content of these elements that may be added arbitrarily is more preferably 1.0% or less.

Number Density of Coarse Secondary Phase Particles

The Cu—Ni—Si based copper alloy is enhanced in strength by utilizing fine precipitation of the secondary phase mainly containing $Ni_2Si$ or $(Ni,Co)_2Si$. In the invention, furthermore, a large KAM value is achieved by dispersing the fine secondary phase particles, targeting the surface smoothing of the etched surface. Coarse particles among the secondary phase particles do not contribute to the increase of the strength and the KAM value. In the case where the secondary phase forming elements, such as Ni, Si, and Co, are consumed in a large amount for the formation of the coarse secondary phase, the precipitation amount of the fine secondary phase becomes insufficient, and the improvement of the strength and the surface smoothing of the etched surface become insufficient. As a result of various investigations, in the aged copper alloy having the aforementioned chemical composition, the number density of the coarse secondary phase particles having a major diameter of 1.0 μm or more is necessarily suppressed to $4.0\times10^3$ per square millimeter or less, on an observation surface obtained by electropolishing a sheet surface (rolled surface), for achieving the improvement of the strength and the surface smoothing of the etched surface. The number density of the coarse secondary phase particles can be controlled by the solution treatment conditions, the aging conditions, and the finish cold rolling conditions.

KAM Value

The inventors have found that the KAM value of the copper alloy sheet material influences the surface smoothness of the etched surface. The mechanisms thereof are still unclear at the present time, but are estimated as follows. The KAM value is a parameter that has correlation to the dislocation density within the crystal grain. In the case where the KAM value is large, it is considered that the average dislocation density in the crystal grain is large, and furthermore the positional fluctuation of the dislocation density is small. As for the etching, it is considered that a portion having a large dislocation density is preferentially etched (corroded). The material having a large KAM value is in a state where the entire of the material uniformly has a large dislocation density, whereby the corrosion by etching rapidly proceeds, and furthermore the progress of local corrosion tends not to occur. It can be estimated that the form of corrosion advantageously acts the formation of the etched surface having less unevenness. As a result, in the formation of pins of a lead frame, fine pins with good linearity can be obtained.

As a result of detailed investigations, it has been found that the surface smoothness of the etched surface is significantly improved in the case where the KAM value (described above) within a crystal grain assuming that a boundary with a crystal orientation difference of 15° or more is the crystal grain boundary, measured with a step size of 0.5 μm by EBSD (electron backscatter diffraction) is 3.00 or more. The KAM value is more preferably 3.20 or more. The upper limit of the KAM value is not particularly determined, and the KAM value may be controlled, for example, to 5.0 or less. The KAM value can be controlled by the chemical composition, the solution treatment conditions, the intermediate cold rolling conditions, the finish cold rolling conditions, and the low temperature annealing conditions.

Average Crystal Grain Diameter

The small average crystal grain diameter on the cross sectional surface (C cross sectional surface) perpendicular to the rolling direction is also advantageous for the formation of the etched surface with smoothness. As a result of investigations, the average crystal grain diameter on the C cross sectional surface defined by the aforementioned item (A) is preferably 2.0 μm or less. Excessive miniaturization is not necessary. For example, the aforementioned average crystal grain diameter may be controlled to a range of 0.10 μm or more or 0.50 μm or more. The average crystal grain diameter can be controlled mainly by the solution treatment conditions.

Shape of Sheet Material

The shape of the Cu—Ni—Si based copper alloy sheet material, i.e., the flatness thereof, largely influences the shape (dimensional accuracy) of the precision current carrying component obtained by processing the sheet material. As a result of various investigations, it is significantly important that after actually cutting the sheet material into a small piece, the curvature (warpage) thereof in the direction perpendicular to the rolling direction occurring after the cutting is small, for stably improving the dimensional accuracy of the component. Specifically, the Cu—Ni—Si based copper alloy sheet material that has a maximum cross bow $q_{MAX}$ defined by the aforementioned item (B) of 100 μm or less has workability capable of stably retaining a high dimensional accuracy as a precision current carrying component for the component derived from any portion with respect to the sheet width $W_0$ in the direction perpendicular to the rolling direction. The maximum cross bow $q_{MAX}$ is more preferably 50 μm or less. Furthermore, the I-unit defined by the aforementioned item (C) is preferably 2.0 or less, and further preferably 1.0 or less.

Strength and Electrical Conductivity

For using the Cu—Ni—Si copper alloy sheet material as a material for a current carrying component, such as a lead frame, a strength level with a 0.2% offset yield strength in the direction (LD) in parallel to the rolling direction of 800 MPa or more is demanded. For thinning the conducting component, good electrical conductivity is also important. Specifically, the electrical conductivity is preferably 35% IACS or more, and more preferably 40% IACS or more.

Production Method

The copper alloy sheet material described above can be produced, for example, by the following production steps:

melting and casting->hot rolling->(cold rolling)->solution treatment->intermediate cold rolling->aging treatment->finish cold rolling->shape correction->low temperature annealing.

While not mentioned in the aforementioned steps, facing may be performed depending on necessity after the hot rolling, and acid pickling, polishing, and optionally degreasing may be performed depending on necessity after each of the heat treatments. The steps will be described below.

Melting and Casting

An ingot may be produced through continuous casting, semi-continuous casting, or the like. For preventing oxidation of Si and the like, the production may be performed in an inert gas atmosphere or with a vacuum melting furnace.

Hot Rolling

The hot rolling may be performed according to an ordinary method. The heating of the cast piece before hot rolling may be performed, for example, at from 900 to 1,000° C. for from 1 to 5 hours. The total hot rolling reduction ratio may be, for example, from 70 to 97%. The rolling temperature of the final pass is preferably 700° C. or more. After completing the hot rolling, quenching by water cooling or the like may be preferably performed.

Before the solution treatment as the subsequent step, cold rolling may be performed for controlling the sheet thickness depending on necessity.

Solution Treatment

The solution treatment mainly intends to dissolve the secondary phase sufficiently, and in the invention, is an important step for controlling the average crystal grain diameter in the sheet thickness direction of the final product. The solution treatment conditions are a heating temperature (i.e., the maximum achieving temperature of the material) of from 850 to 950° C. and a retention time in the temperature range (i.e., the period of time where the temperature of the material is in the temperature range) of from 10 to 50 seconds. In the case where the heating temperature is too low and the case where the retention time is too short, the solution treatment may be insufficient to fail to provide a sufficiently high strength finally. In the case where the heating temperature is too high and the case where the retention time is too long, a large KAM value cannot be obtained finally, and the crystal grains tend to be coarse. The cooling rate may be quenching to such an extent that can be performed in an ordinary continuous annealing line. For example, the average cooling rate from 530° C. to 300° C. is preferably 100° C./s or more.

Intermediate Cold Rolling

Cold rolling is performed before the aging treatment, for reducing the sheet thickness and introducing strain energy (dislocation). The cold rolling in this stage is referred to as an "intermediate cold rolling" in the description herein. It has been found that for increasing the KAM value in the final product, it is effective to perform the aging treatment to a sheet material in a state where strain energy is introduced thereto. For achieving the effect sufficiently, the rolling reduction ratio in the intermediate cold rolling is preferably 30% or more, and more preferably 35% or more. However, when the sheet thickness is excessively reduced in this stage, it may be difficult in some cases to ensure the rolling reduction ratio that is necessary in the finish cold rolling described later. Accordingly, the rolling reduction ratio in the intermediate cold rolling is preferably set in a range of 90% or less, and may be managed to 75% or less.

Aging Treatment

The aging treatment is then performed to precipitate the fine precipitate particles contributing to the strength. The precipitation proceeds under the state where the strain in the intermediate cold rolling is introduced thereto. The precipitation performed in the state where the cold rolling strain is introduced thereto is effective for increasing the final KAM value. Although the mechanism thereof is not necessarily clear, it is estimated that by facilitating the precipitation by utilizing the strain energy, the fine precipitates can be formed further uniformly. It is preferred that the conditions therefor are determined by adjusting the temperature and the period of time in advance that provide maximum hardness by aging, depending on the alloy composition. The heating temperature of the aging treatment herein is restricted to 500° C. or less. A temperature higher than that tends to cause overaging, which makes difficult to control the prescribed high strength stably. In the case where the heating temperature is lower than 400° C., on the other hand, the precipitation may be insufficient, which may be a factor causing insufficient strength and low electrical conductivity The retention time in a range of from 400 to 500° C. may be set in a range of from 7 to 15 hours.

In the cooling process in the aging treatment, it is important to perform cooling at a maximum cooling rate to 300° C. of 50° C./h or less. In other words, a cooling rate exceeding 50° C./h is prevented from occurring until the temperature is decreased at least to 300° C. after the aforementioned heating. During the cooling, the secondary phase, the solubility of which is gradually decreased associated with the decrease of the temperature, is further precipitated. By decreasing the cooling rate to 50° C./h or less, the fine secondary phase particles effective for the improvement of the strength can be formed in a large amount. It has been found that a cooling rate to 300° C. exceeding 50° C./h facilitate the formation of coarse particles with the secondary phase precipitated in the temperature range. The precipitation contributing to the strength may not occur in a low temperature range lower than 300° C., and thus it suffices to restrict the maximum cooling rate in a temperature range of 300° C. or more. The excessive decrease of the maximum cooling rate to 300° C. may cause deterioration of the productivity. The maximum cooling rate to 300° C. may be generally set in a range of 10° C./h or more.

Finish Cold Rolling

The final cold rolling performed after the aging treatment is referred to as a "finish cold rolling" in the description herein. The finish cold rolling is effective for the improvement of the strength level (particularly the 0.2% offset yield strength) and the KAM value. The rolling reduction ratio of the finish cold rolling is effectively 20% or more, and more effectively 25% or more. With an excessively large rolling reduction ratio in the finish cold rolling, the strength may be decreased in the low temperature annealing, and thus the rolling reduction ratio is preferably 85% or less, and may be managed to a range of 80% or less. The final sheet thickness may be set, for example, in a range of approximately from 0.06 to 0.30 mm.

In general, the use of a work roll having a small diameter is advantageous for increasing the single rolling reduction ratio in the cold rolling. However, for the improvement of the flatness of the sheet shape, it is significantly effective to use a large diameter work roll having a diameter of 65 mm or more. With a work roll having a smaller diameter than that, the flatness of the sheet shape is readily deteriorated due to the influence of work roll bending. When the diameter of the work roll is excessively large, on the other hand, the milling power necessary for sufficiently ensuring the single rolling reduction ratio is increased associated with the decrease of the sheet thickness, which is disadvantageous for finishing to provide the prescribed sheet thickness. The upper limit of the large diameter work roll used may be determined depending on the milling power of the cold rolling machine and the target sheet thickness. For example, in the case where the sheet material in the aforementioned thickness range is to be obtained with a rolling reduction ratio in the final cold rolling of 30% or more, a work roll having a diameter of 100 mm or less is preferably used, and it is more effective to use a work roll having a diameter of 85 mm or less.

For the improvement of the flatness of the sheet shape, it is significantly effective that the single rolling reduction ratio in the final pass of the finish cold rolling is 15% or less, and more preferably 10% or less. An excessively small single rolling reduction ratio in the final pass may cause deterioration of the productivity, and thus it is preferred to ensure a single rolling reduction ratio of 2% or more.

Shape Correction

The sheet material having been subjected to the finish cold rolling is subjected to shape correction with a tension leveler, before subjecting to the final low temperature annealing. The tension leveler is a device that bends and unbends a sheet material with plural shape correction rolls while applying a tension in the rolling direction. In the invention, for improving the flatness of the sheet shape, the deformation applied to the sheet material is strictly restricted by processing the sheet material by the tension leveler. Specifically, the sheet material is subjected to continuous repeated bending work with a processing condition that forms deformation with an elongation rate of from 0.1 to 1.5% with the tension leveler. With an elongation rate of less than 0.1% or less, the effect of the shape correction may be insufficient to fail to achieve the intended flatness. In the case where the elongation rate exceeds 1.5%, on the other hand, the intended flatness may not be obtained due to the influence of plastic deformation caused by the shape correction. It is preferred that the shape correction is performed with an elongation rate in a range of 1.2% or less.

Low Temperature Annealing

After the finish cold rolling, low temperature annealing is generally performed for the reduction of the residual stress of the sheet material and the improvement of the bend formability thereof, and for the improvement of the stress relaxation resistance by reducing the vacancy and the dislocation on the glide plane. In the invention, the low temperature annealing is utilized also for providing the KAM value improvement effect and the shape correction effect. For sufficiently providing the effects, it is necessary that the conditions for the low temperature annealing, which is the final heat treatment, are strictly restricted.

Firstly, the heating temperature (maximum achieving temperature) of the low temperature annealing is set to from 400 to 500° C. In the temperature range, rearrangement of the dislocations occurs, and the solute atoms form the Cottrell atmosphere to form a strain field in the crystal lattice. It is considered that the lattice strain becomes a factor enhancing the KAM value. In low temperature annealing at from 250 to 375° C., which is frequently used as ordinary low temperature annealing, the shape correction effect can be obtained by the application of a tension described later, but the effect of significantly enhancing the KAM value has not been observed in the previous investigations. With a heating temperature exceeding 500° C., on the other hand, both the strength and the KAM value are decreased due to softening. The retention time at from 400 to 500° C. may be set to a range of from 5 to 600 seconds.

Secondly, at least in the period where the temperature of the material is at the maximum achieving temperature set to from 400 to 500° C., a tension of from 40 to 70 $N/mm^2$ is applied in a rolling direction of the sheet. When the tension is too small, the shape correction effect becomes insufficient particularly for a high strength material, and it is difficult to achieve high flatness stably. When the tension is too large, the strain distribution in the direction perpendicular to the sheet surface (i.e., the direction perpendicular to the rolling direction) with respect to the tension tends to be uneven, and it is difficult to achieve high flatness also in this case. The period of time of the application of the tension is preferably 1 second or more. The tension may be continuously applied over the entire period where the temperature of the material is in a range of from 400 to 500° C.

Thirdly, the temperature is raised to the aforementioned maximum achieving temperature at a maximum temperature rising rate of 150° C./s or less. In other words, the temperature is raised to the maximum achieving temperature at a temperature rising rate that is prevented from exceeding 150° C./s in the temperature rising process. It has been found that when the temperature rising rate exceeds the value, disappearance of dislocations tends to occur in the temperature rising process, and the KAM value is decreased. The maximum temperature rising rate is more effectively 100° C./s or less. However, a too small temperature rising rate may deteriorate the productivity. The maximum temperature rising rate to the maximum achieving temperature is preferably set, for example, to a range of 20° C./s or more.

Fourthly, the sheet material is cooled to ordinary temperature at a maximum cooling rate of 100° C./s or less. That is, the temperature is decreased to ordinary temperature (5 to 35° C.), after the aforementioned heating, at a temperature cooling rate that is prevented from exceeding 100° C./s. With a maximum cooling rate exceeding 100° C./s, the temperature distribution in the direction perpendicular to the sheet surface (i.e., the direction perpendicular to the rolling direction) with respect to the rolling direction on cooling may be uneven, and sufficient flatness may not be obtained. However, a too small cooling rate may deteriorate the productivity. The maximum cooling rate may be set to a range of 10° C./s or more.

EXAMPLES

The copper alloys having the chemical compositions shown in Table 1 were melted and prepared, and cast with a vertical semi-continuous casting machine. The resulting ingots each were heated to 1,000° C. for 3 hours and then extracted, and were subjected to hot rolling to a thickness of 14 mm, followed by being cooled with water. The total hot rolling reduction ratio was from 90 to 95%. After the hot rolling, the surface oxide is removed by milling, and subjected to cold rolling of from 80 to 98%, so as to produce an intermediate product sheet material to be subjected to a solution treatment. The intermediate product sheet materials each were subjected to a solution treatment, intermediate cold rolling, an aging treatment, finish cold rolling, shape correction with a tension leveler, and low temperature annealing, under the conditions shown in Tables 2 and 3. For a part of Comparative Examples (No. 34), the sheet material having been faced after the hot rolling was subjected to cold rolling of 90%, and the resulting material was used as an intermediate product sheet material and subjected to a solution treatment, omitting the intermediate cold rolling. The sheet material after the low temperature annealing was slit to provide a sheet material product (test material) having a sheet thickness of from 0.10 to 0.15 mm and a sheet width $W_0$ in the direction perpendicular to the rolling direction of 510 mm.

In Tables 2 and 3, the temperature of the solution treatment shows the maximum achieving temperature. The time of the solution treatment shows the period of time where the temperature of the material is in a range of 850° C. or more and the maximum achieving temperature or less. In the examples where the maximum achieving temperature is less than 850° C., the retention time at the maximum achieving temperature is shown. In the cooling process of the aging treatment, the furnace temperature was decreased at a constant cooling rate. The maximum cooling rate of the aging treatment shown in Tables 2 and 3 corresponds to the aforementioned "constant cooling rate" from the heating temperature (i.e., the maximum achieving temperature shown in Tables 2 and 3) to 300° C.

The low temperature annealing was performed in such a manner that the sheet material was processed in a catenary furnace and then air-cooled. The temperature of the low temperature annealing shown in Tables 2 and 3 is the maximum achieving temperature. The sheet material in the middle of the furnace was applied with a tension in the rolling direction shown in Tables 2 and 3. The tension can be calculated from the catenary curve of the material in the middle of the furnace (i.e., the height positions of the sheet at the both end portions in the rolling direction and the center portion in the furnace, and the length inside the furnace). The period of time where the temperature of the material was in a range of 400° C. or more and the maximum achieving temperature or less (in the examples where the maximum achieving temperature was less than 400° C., the period of time where the temperature of the material was retained to approximately the maximum achieving temperature) was from 10 to 90 seconds. The aforementioned tension was applied to the sheet at least within the period of time. The temperature of the sheet surface was measured at various positions in the rolling direction during heating and cooling, and thereby a temperature rising curve and a cooling curve with the abscissa for the time and the ordinate for the temperature were obtained. The test material was heated and cooled under the same conditions over the entire length of the sheet during processing, and thus the maximum gradients of the temperature rising curve and the cooling curve were designated as the maximum temperature rising rate and the maximum cooling rate of the test material respectively. The temperature rising rate and the cooling rate were controlled by the atmospheric gas temperatures of the temperature rising zone and the cooling zone, the rotation number of the fan, and the like.

TABLE 1

| Class | No. | Chemical Composition (% by mass) Cu | Ni | Si | Others |
|---|---|---|---|---|---|
| Example of Invention | 1 | balance | 2.60 | 0.61 | — |
| | 2 | balance | 2.40 | 0.56 | Mg: 0.15 |
| | 3 | balance | 2.45 | 0.90 | Co: 1.30 |
| | 4 | balance | 1.40 | 0.50 | Sn: 0.25, Zn: 0.80, Zr: 0.03 |
| | 5 | balance | 3.12 | 0.84 | Co: 0.16, P: 0.02 |
| | 6 | balance | 2.63 | 0.55 | B: 0.005, Fe: 0.16 |
| | 7 | balance | 2.52 | 0.59 | Ti: 0.08, Al: 0.12 |
| | 8 | balance | 2.88 | 0.67 | Mn: 0.14, Cr: 0.10 |
| | 9 | balance | 2.30 | 0.44 | Sn: 0.36, Ti: 0.12 |
| | 10 | balance | 3.50 | 0.80 | Mg: 0.18 |
| | 11 | balance | 2.52 | 0.58 | Zn: 0.30, Sn: 0.35 |
| | 12 | balance | 3.00 | 0.65 | Mg: 0.15 |

TABLE 1-continued

| Class | No. | Chemical Composition (% by mass) Cu | Ni | Si | Others |
|---|---|---|---|---|---|
| Comparative Example | 31 | balance | 2.40 | 0.52 | Mg: 0.16 |
| | 32 | balance | 2.78 | 0.55 | — |
| | 33 | balance | 2.39 | 0.44 | Mg: 0.14 |
| | 34 | balance | 2.40 | 0.56 | Sn: 0.25, Zn: 0.80, Zr: 0.03 |
| | 35 | balance | 2.43 | 0.55 | Co: 0.16, P: 0.02 |
| | 36 | balance | 2.39 | 0.58 | — |
| | 37 | balance | 5.00 | 0.78 | — |
| | 38 | balance | 0.85 | 0.48 | — |
| | 39 | balance | 2.80 | 1.50 | — |
| | 40 | balance | 2.10 | 0.05 | — |
| | 41 | balance | 2.48 | 0.60 | — |
| | 42 | balance | 2.48 | 0.60 | — |
| | 43 | balance | 2.39 | 0.57 | — |
| | 44 | balance | 2.50 | 0.49 | Mg: 0.14 |
| | 45 | balance | 2.50 | 0.49 | — |
| | 46 | balance | 2.60 | 0.75 | — |
| | 47 | balance | 3.00 | 0.65 | Mg: 0.15 |

Underline: outside the scope of the invention

TABLE 2

| Class | No. | Solution treatment Temperature (° C.) | Solution treatment Time (s) | Intermediate cold rolling Rolling reduction ratio (%) | Aging treatment Temperature (° C.) | Aging treatment Time (h) | Aging treatment Maximum cooling rate (° C./h) | Finish cold rolling Rolling reduction ratio (%) |
|---|---|---|---|---|---|---|---|---|
| Example of Invention | 1 | 900 | 20 | 45 | 440 | 8.5 | 20 | 64 |
| | 2 | 900 | 30 | 60 | 460 | 10.0 | 15 | 50 |
| | 3 | 945 | 20 | 60 | 460 | 10.0 | 15 | 75 |
| | 4 | 900 | 20 | 60 | 440 | 10.0 | 25 | 75 |
| | 5 | 900 | 15 | 60 | 460 | 10.0 | 15 | 75 |
| | 6 | 900 | 20 | 60 | 460 | 10.0 | 15 | 75 |
| | 7 | 900 | 25 | 75 | 480 | 10.0 | 15 | 60 |
| | 8 | 900 | 25 | 60 | 460 | 13.0 | 15 | 98 |
| | 9 | 875 | 25 | 60 | 460 | 10.0 | 20 | 75 |
| | 10 | 900 | 20 | 60 | 420 | 10.0 | 20 | 75 |
| | 11 | 900 | 20 | 60 | 440 | 10.0 | 20 | 63 |
| | 12 | 900 | 20 | 60 | 460 | 10.0 | 20 | 63 |

| Class | No. | Finish cold rolling Diameter of work roll (mm) | Finish cold rolling Single rolling reduction ratio in final pass (%) | Finish cold rolling Tension leveler Elongation rate (%) | Low temperature annealing Maximum temperature rising rate (° C./s) | Low temperature annealing Temperature (° C.) | Low temperature annealing Tension ($N/mm^2$) | Low temperature annealing Maximum cooling rate (° C./s) |
|---|---|---|---|---|---|---|---|---|
| Example of Invention | 1 | 80 | 9.9 | 0.25 | 45 | 450 | 55 | 30 |
| | 2 | 80 | 7.9 | 0.25 | 55 | 450 | 55 | 40 |
| | 3 | 75 | 6.4 | 1.00 | 75 | 450 | 55 | 48 |
| | 4 | 85 | 4.5 | 0.25 | 75 | 450 | 55 | 65 |
| | 5 | 85 | 7.9 | 0.15 | 62 | 450 | 55 | 62 |
| | 6 | 85 | 6.4 | 0.25 | 75 | 500 | 55 | 80 |
| | 7 | 70 | 6.4 | 0.75 | 50 | 450 | 65 | 50 |
| | 8 | 75 | 6.4 | 0.25 | 80 | 475 | 55 | 39 |
| | 9 | 80 | 7.9 | 0.75 | 75 | 475 | 45 | 47 |
| | 10 | 80 | 6.4 | 0.75 | 100 | 475 | 55 | 48 |
| | 11 | 75 | 6.4 | 0.25 | 57 | 450 | 55 | 46 |
| | 12 | 80 | 6.4 | 0.25 | 68 | 475 | 55 | 40 |

TABLE 3

| Class | No. | Solution treatment Temperature (° C.) | Solution treatment Time (s) | Intermediate cold rolling Rolling reduction ratio (%) | Aging treatment Temperature (° C.) | Aging treatment Time (h) | Aging treatment Maximum cooling rate (° C./h) | Finish cold rolling Rolling reduction ratio (%) |
|---|---|---|---|---|---|---|---|---|
| Comparative Example | 31 | 900 | 25 | 60 | 460 | 10.0 | 20 | 0 |
| | 32 | 1000 | 20 | 60 | 460 | 10.0 | 15 | 75 |
| | 33 | 825 | 15 | 60 | 460 | 10.0 | 15 | 75 |
| | 34 | 900 | 25 | 0 | 500 | 10.0 | 15 | 35 |
| | 35 | 900 | 20 | 60 | 350 | 10.0 | 15 | 75 |
| | 36 | 925 | 20 | 60 | 550 | 10.0 | 15 | 75 |
| | 37 | 900 | 20 | 60 | 460 | 10.0 | 15 | 75 |
| | 38 | 925 | 15 | 60 | 460 | 10.0 | 20 | 75 |
| | 39 | 900 | 15 | 60 | 460 | 10.0 | 20 | 75 |
| | 40 | 900 | 15 | 60 | 460 | 10.0 | 20 | 75 |
| | 41 | 900 | 15 | 60 | 460 | 5.0 | 20 | 75 |
| | 42 | 900 | 15 | 60 | 460 | 17.0 | 20 | 75 |
| | 43 | 875 | 15 | 60 | 440 | 9.0 | 80 | 75 |
| | 44 | 900 | 20 | 60 | 440 | 10.0 | 15 | 75 |
| | 45 | 900 | 5 | 60 | 440 | 10.0 | 20 | 75 |
| | 46 | 900 | 90 | 60 | 440 | 10.0 | 20 | 75 |
| | 47 | 900 | 15 | 0 | 440 | 10.0 | 20 | 75 |

| Class | No. | Finish cold rolling Diameter of work roll (mm) | Finish cold rolling Single rolling reduction ratio in final pass (%) | Finish cold rolling Tension leveler Elongation rate (%) | Low temperature annealing Maximum temperature rising rate (° C./s) | Low temperature annealing Temperature (° C.) | Low temperature annealing Tension (N/mm$^2$) | Low temperature annealing Maximum cooling rate (° C./s) |
|---|---|---|---|---|---|---|---|---|
| Comparative Example | 31 | 75 | 7.9 | 0.20 | 80 | 475 | 55 | 20 |
| | 32 | 75 | 7.9 | 0.15 | 75 | 475 | 55 | 70 |
| | 33 | 70 | 9.9 | 0.05 | 55 | 475 | 55 | 48 |
| | 34 | 75 | 7.9 | 0.20 | 80 | 450 | 45 | 40 |
| | 35 | 75 | 6.4 | 0.25 | 55 | 475 | 55 | 62 |
| | 36 | 75 | 7.9 | 0.25 | 80 | 450 | 20 | 42 |
| | 37 | 75 | 7.9 | 0.25 | 62 | 450 | 55 | 38 |
| | 38 | 80 | 7.9 | 0.20 | 65 | 475 | 55 | 38 |
| | 39 | 70 | 9.9 | 0.20 | 55 | 475 | 55 | 48 |
| | 40 | 75 | 7.9 | 0.20 | 52 | 475 | 55 | 50 |
| | 41 | 75 | 7.9 | 0.20 | 46 | 475 | 55 | 200 |
| | 42 | 85 | 25.0 | 0.15 | 75 | 475 | 55 | 55 |
| | 43 | 45 | 6.4 | 0.20 | 45 | 475 | 55 | 45 |
| | 44 | 70 | 6.4 | 0.15 | 250 | 375 | 55 | 50 |
| | 45 | 70 | 9.9 | 2.00 | 80 | 475 | 55 | 48 |
| | 46 | 80 | 7.9 | 0.20 | 75 | 475 | 120 | 50 |
| | 47 | 75 | 7.9 | 0.20 | 65 | 475 | 55 | 50 |

Underline: outside the scope of the invention

The test materials were measured for the following factors.

Number Density of Coarse Secondary Phase Particles

According to the "Method for obtaining Number Density of Coarse Secondary Phase Particles" described above, an observation surface obtained by electropolishing the sheet surface (rolled surface) was observed with an SEM, and the number density of the secondary phase particles having a major diameter of 1.0 μm or more was obtained. The electropolishing solution for preparing the observation surface was a liquid obtained by mixing distilled water, phosphoric acid, ethanol, and 2-propanol at a ratio of 2/1/1/1. The electropolishing was performed by using an electropolishing device, produced by Buehler (ELECTROPOLISHER POWER SUPPLUY, ELECTROPOLISHER CELL MODULE) at a voltage of 15 V and a time of 20 seconds.

KAM Value

According to the "Method for obtaining KAM Value" described above, an observation surface at a removal depth of 1/10 of the sheet thickness from the rolled surface was measured by using an FE-SEM equipped with an EBSD analysis system (JSM-7001, produced by JEOL, Ltd.). The acceleration voltage for the electron beam irradiation was 15 kV, and the irradiation current therefor was $5\times10^{-8}$ A. The EBSD analysis software used was OIM Analysis, produced by TSL Solutions, Ltd.

Average Crystal Grain Diameter in Sheet Thickness Direction

An observation surface obtained by etching the cross sectional surface (C cross sectional surface) perpendicular to the rolling direction to expose the crystal grain boundary was observed with an SEM, and the average crystal grain diameter in the sheet thickness direction defined by the aforementioned item (A) was obtained.

Electrical Conductivity

The test materials each were measured for electrical conductivity according to JIS H0505. In consideration of the purpose for a lead frame, a test material having an electrical conductivity of 35% IACS or more was evaluated as acceptable (good electrical conductivity).

0.2% Offset Yield Strength in Rolling Direction

A tensile test piece (JIS No. 5) in the rolling direction (LD) was collected from each of the test materials, and a tensile test according to JIS 22241 was performed with a number n of specimens of 3, so as to measure the 0.2% offset yield strength. An average value of the three specimens was designated as the performance value of the test material. In consideration of the purpose for a lead frame, a test material having a 0.2% offset yield strength of 800 Pa or more was evaluated as acceptable (good high strength characteristics).

Surface Roughness of Etched Surface

A 42 Baume ferric chloride solution was prepared as an etching solution. One surface of the test material was etched until the sheet thickness was decreased by half. The resulting etched surface was measured for the surface roughness in the direction perpendicular to the rolling direction with a surface roughness meter using laser beam, and the arithmetic average roughness Ra according to JIS B0601:2013 was obtained. With a value of Ra of 0.15 μm or less by the etching test, it can be evaluated that the surface smoothness of the etched surface is significantly improved as compared to an ordinary Cu—Ni—Si based copper alloy sheet material. Specifically, etching property capable of forming pins having good linearity with high accuracy in the production of a high precision lead frame is provided. Accordingly, a test material having the value of Ra of 0.15 μm or less was evaluated as acceptable (good etching property).

I-Unit

A rectangular cut sheet Q having a length in the rolling direction of 400 mm and a length in the direction perpendicular to the rolling direction of a sheet width $W_0$ (mm) was collected from each of the test materials, and the I-unit defined by the aforementioned item (C) was obtained.

Maximum Cross Bow $q_{MAX}$

The test materials each were measured for the maximum cross bow $q_{MAX}$ defined by the aforementioned item (B).

A test material having an I-unit of 5.0 or less and a maximum cross bow $q_{MAX}$ of 100 μm or less was evaluated as acceptable for the sheet shape.

The results are shown in Table 4.

TABLE 4

| Class | No. | Number density of coarse secondary phase particles ($\times 10^3/mm^2$) | KAM value | Average crystal grain diameter in sheet thickness direction (μm) | Electrical conductivity (% IACS) | 0.2% Offset yield strength (MPa) | Surface roughness of etched surface Ra (μm) | I-unit | Maximum crossbow $q_{MAX}$ (μm) |
|---|---|---|---|---|---|---|---|---|---|
| Example of Invention | 1 | 1.9 | 3.66 | 0.86 | 41.0 | 848 | 0.09 | 1.7 | 25 |
| | 2 | 0.5 | 3.30 | 1.40 | 45.8 | 910 | 0.14 | 2.2 | 32 |
| | 3 | 1.4 | 3.43 | 1.72 | 44.2 | 862 | 0.13 | 2.5 | 37 |
| | 4 | 2.6 | 3.66 | 0.73 | 45.6 | 817 | 0.12 | 2.4 | 36 |
| | 5 | 1.6 | 3.99 | 0.55 | 43.8 | 844 | 0.08 | 3.7 | 55 |
| | 6 | 0.4 | 3.66 | 0.73 | 47.6 | 914 | 0.12 | 3.8 | 57 |
| | 7 | 0.9 | 3.74 | 0.92 | 45.1 | 858 | 0.09 | 2.9 | 43 |
| | 8 | 1.1 | 3.70 | 0.81 | 43.0 | 885 | 0.11 | 2.7 | 40 |
| | 9 | 0.5 | 3.66 | 0.61 | 45.0 | 903 | 0.12 | 2.6 | 39 |
| | 10 | 1.5 | 3.50 | 0.73 | 44.4 | 847 | 0.13 | 2.9 | 43 |
| | 11 | 0.6 | 3.67 | 0.79 | 46.3 | 888 | 0.12 | 2.4 | 36 |
| | 12 | 0.8 | 3.57 | 0.79 | 46.8 | 832 | 0.13 | 2.0 | 31 |
| Comparative Example | 31 | 0.6 | 2.51 | 2.33 | 41.2 | 876 | 0.22 | 1.8 | 27 |
| | 32 | 0.2 | 2.73 | 13.49 | 47.6 | 961 | 0.20 | 3.1 | 47 |
| | 33 | 10.4 | 3.95 | 0.13 | 44.0 | 739 | 0.10 | 10.5 | 158 |
| | 34 | 0.8 | 2.28 | 0.92 | 44.1 | 849 | 0.23 | 3.7 | 56 |
| | 35 | 5.4 | 3.65 | 0.73 | 34.0 | 731 | 0.12 | 2.9 | 44 |
| | 36 | 5.0 | 3.29 | 1.04 | 50.0 | 750 | 0.14 | 6.4 | 96 |
| | 37 | 0.7 | 2.27 | 0.73 | 31.5 | 859 | 0.23 | 2.6 | 39 |
| | 38 | 9.6 | 3.61 | 0.78 | 50.0 | 760 | 0.12 | 2.4 | 36 |
| | 39 | 10.2 | 3.88 | 0.55 | 30.1 | 744 | 0.11 | 4.2 | 63 |
| | 40 | 18.0 | 3.92 | 0.53 | 52.5 | 550 | 0.10 | 2.9 | 43 |
| | 41 | 4.9 | 4.01 | 0.55 | 34.2 | 757 | 0.10 | 10.2 | 152 |
| | 42 | 4.4 | 3.66 | 0.56 | 50.2 | 779 | 0.12 | 11.9 | 178 |
| | 43 | 4.5 | 4.23 | 0.37 | 34.5 | 774 | 0.09 | 10.0 | 150 |
| | 44 | 0.4 | 2.56 | 0.73 | 37.5 | 927 | 0.21 | 17.2 | 258 |
| | 45 | 10.2 | 4.62 | 0.18 | 44.0 | 744 | 0.07 | 18.8 | 282 |
| | 46 | 0.0 | 2.46 | 6.00 | 37.4 | 999 | 0.22 | 8.0 | 121 |
| | 47 | 0.7 | 2.43 | 1.27 | 41.8 | 868 | 0.25 | 3.6 | 54 |

Underline: outside the scope of the invention

In all Examples of Invention, in which the chemical composition and the production conditions were strictly controlled according to the aforementioned regulations, a large KAM value was obtained, and the crystal grain diameter in the sheet thickness direction was reduced. As a result thereof, the etched surface had excellent surface smoothness. The number density of coarse secondary phase particles was suppressed to low levels, and good electrical conductivity and good strength were obtained. Furthermore, a good sheet shape was also obtained.

On the other hand, in Comparative Example No. 31, the KAM value was small, and the crystal grain diameter in the sheet thickness direction was large, since the finish cold rolling was omitted. As a result thereof, the surface smoothness of the etched surface was deteriorated. In No. 32, the KAM value was small, and the crystal grain diameter in the sheet thickness direction was large, since the temperature of the solution treatment was high. As a result thereof, the surface smoothness of the etched surface was deteriorated. In No. 33, the amount of the coarse secondary phase particles was increased, and the strength was deteriorated, since the temperature of the solution treatment was low.

Furthermore, the sheet shape was deteriorated since the elongation rate with a tension leveler was insufficient. In No. 34, the KAM value was decreased, and the surface smoothness of the etched surface was deteriorated, since the intermediate cold rolling was omitted. In No. 35, the amount of the coarse secondary phase particles was increased, and the strength and the electrical conductivity were deteriorated, since the temperature of the aging treatment was low. In No. 36, the amount of the coarse secondary phase particles was increased, and the strength was deteriorated, since the temperature of the aging treatment was high. Furthermore, the sheet shape was deteriorated since the tension in the low temperature annealing was small. In No. 37, the electrical conductivity was low, the KAM value was small, and the surface smoothness of the etched surface was deteriorated, since the Ni content was large. In No. 38, the amount of the coarse secondary phase particles was increased, and the strength was deteriorated, since the Ni content was small. In No. 39, the electrical conductivity was deteriorated, the KAM value was small, and the surface smoothness of the etched surface was deteriorated, since the Si content was large. In No. 40, the amount of the coarse secondary phase particles was increased, and the strength was deteriorated, since the Si content was small. In No. 41, the amount of the coarse secondary phase particles was increased, and the strength and the electrical conductivity were deteriorated, since the period of time of the aging treatment was short. Furthermore, the sheet shape was deteriorated since the maximum cooling rate in the low temperature annealing was large. In No. 42, the amount of the coarse secondary phase particles was increased, and the strength was deteriorated, since the period of time of the aging treatment was long. Furthermore, the sheet shape was deteriorated since the single rolling reduction ratio in the final pass of the finish cold rolling was large. In No. 43, the amount of the coarse secondary phase particles was increased, and the strength and the electrical conductivity orated, since the maximum cooling rate in the aging treatment was large. Furthermore, the sheet shape was deteriorated since the diameter of the work roll used in the finish cold rolling was small. In No. 44, the KAM value was small, and the surface smoothness of the etched surface was deteriorated, since the maximum temperature rising rate in the low temperature annealing was large, and the heating temperature of the low temperature annealing was low. Furthermore, the sheet shape was deteriorated since the heating temperature of the low temperature annealing was low. In No. 45, the amount of the coarse secondary phase particles was increased, and the strength was deteriorated, since the period of time of the solution treatment was short. Furthermore, sheet shape was deteriorated since the elongation rate with a tension leveler was large. In No. 46, the KAM value was small, and the crystal grain diameter in the sheet thickness direction was large, since the period of time of the solution treatment was long. As a result thereof, the surface smoothness of the etched surface was deteriorated. Furthermore, the sheet shape was deteriorated since the tension in the low temperature annealing was large. In No. 47, the KAM value was small, and the surface smoothness of the etched surface was deteriorated, since the intermediate cold rolling was omitted.

The invention claimed is:

1. A copper alloy sheet material having: a composition containing, in terms of percentage by mass, from 1.0 to 4.5% of Ni, from 0.1 to 1.2% of Si, from 0 to 0.3% of Mg, from 0 to 0.2% of Cr, from 0 to 2.0% of Co, from 0 to 0.1% of P, from 0 to 0.05% of B, from 0 to 0.2% of Mn, from 0 to 0.5% of Sn, from 0 to 0.5% of Ti, from 0 to 0.2% of Zr, from 0 to 0.2% of Al, from 0 to 0.3% of Fe, from 0 to 1.0% of Zn, the balance of Cu, and unavoidable impurities; having a number density of coarse secondary phase particles having a major diameter of 1.0 μm or more of $4.0\times10^3$ per square millimeter or less, on an observation surface in parallel to a sheet surface (rolled surface); and having a KAM value measured with a step size of 0.5 μm of more than 3.00, within a crystal grain assuming that a boundary with a crystal orientation difference of 15° or more by EBSD (electron backscatter diffraction) is a crystal grain boundary, wherein the copper alloy sheet material has a 0.2% offset yield strength in a rolling direction of 800 MPa or more and an electrical conductivity of 35% IACS or more.

2. The copper alloy sheet material according to claim, 1, wherein the copper alloy sheet material has an average crystal grain diameter in a sheet thickness direction defined by the following item (A) of 2.0 μm or less:

(A) straight lines are randomly drawn in the sheet thickness direction on an SEM micrograph obtained by observing a cross sectional surface (C cross sectional surface) perpendicular to the rolling direction, and an average cut length of crystal grains cut by the straight lines is designated as the average crystal grain diameter in the sheet thickness direction, provided that plural straight lines are randomly set in such a manner that a total number of crystal grains cut by the straight lines is 100 or more, and the straight lines do not cut the same crystal grain within one or plural observation view fields.

3. The copper alloy sheet material according to claim, 1, wherein the copper alloy sheet material has a maximum cross bow $q_{MAX}$ defined by the following item (B) of 100 μm or less with a sheet width $W_0$ (mm) in a direction perpendicular to a rolling direction:

(B) a rectangular cut sheet P having a length in the rolling direction of 50 mm and a length in the direction perpendicular to the rolling direction of a sheet width $W_0$ (mm) is collected from the copper alloy sheet material, and the cut sheet P is further cut with a pitch of 50 mm in the direction perpendicular to the rolling direction, at which when a small piece having a length in the direction perpendicular to the rolling direction of less than 50 mm is formed at an end part in the direction perpendicular to the rolling direction of the cut sheet P, the small piece is removed, so as to prepare n pieces of square specimens of 50 mm square (wherein n is an integer part of the sheet width $W_0/50$); the square specimens each are measured for a cross bow q when the specimen is placed on a horizontal plate in the direction perpendicular to the rolling direction for both surfaces thereof (sheet surfaces on both sides thereof), according to a measurement method with a three-dimensional measurement equipment defined in JCBA (Japan Copper and Brass Association) T320:2003 (wherein w=50 mm), and a maximum value of absolute values |q| of the values q of the both surfaces is designated as a cross bow $q_i$ (wherein i is from 1 to n) of the square specimen; and a maximum value of the cross bows $q_1$ to $q_n$ of n pieces of the square specimens is designated as the maximum cross bow $q_{MAX}$.

4. The copper alloy sheet material according to claim, 1, wherein the copper alloy sheet material has an I-unit defined by the following item (C) of 5.0 or less:

(C) a rectangular cut sheet Q having a length in a rolling direction of 400 mm and a length in a direction perpendicular to the rolling direction of a sheet width $W_0$ (mm) is collected from the copper alloy sheet material, and placed on a horizontal plate; in a projected surface of the cut plate Q viewed in a vertical direction (which is hereinafter referred simply to as a "projected surface"), a rectangular region X having a length in the rolling direction of 400 mm and a length in the direction perpendicular to the rolling direction of a sheet width $W_0$ is determined, and the rectangular region X is further cut into strip regions with a pitch of 10 mm in the direction perpendicular to the rolling direction, at which when a narrow strip region having a length in the direction perpendicular to the rolling direction of less than 10 mm is formed at an end part in the direction perpendicular to the rolling direction of the rectangular region X, the narrow strip region is removed, so as to determine n positions of strip regions (each having a length of 400 mm and a width of 10 mm) adjacent to each other (wherein n is an integer part of the sheet width $W_0/10$); the strip regions each are measured for a surface height at a center in width over the length of 400 mm in the rolling direction, a difference $h_{MAX}-h_{MIN}$ of a maximum height $h_{MAX}$ and a minimum height $h_{MIN}$ is designated as a wave height h, and a differential elongation rate e obtained by the following expression (1) is designated as a differential elongation rate $e_i$ (wherein i is from 1 to n) of the strip region; and a maximum value of the differential elongation rates $e_1$ to $e_n$ of the n positions of the strip regions is designated as the I-unit:

$$e=(\pi/2\times h/L)^2 \quad (1)$$

wherein L represents a standard length of 400 mm.

5. The copper alloy sheet material according to claim, 1, wherein the copper alloy sheet material has a sheet thickness of from 0.06 to 0.30 mm.

6. A copper alloy sheet material for a lead frame, which is the copper alloy sheet material according to claim 1.

* * * * *